US010493327B2

(12) United States Patent
Simonutti et al.

(10) Patent No.: US 10,493,327 B2
(45) Date of Patent: Dec. 3, 2019

(54) TENNIS BALL HAVING A CORE WITH INTERNAL MATERIAL SHIFT LINES

(71) Applicant: Wilson Sporting Goods Co., Chicago, IL (US)

(72) Inventors: Frank M. Simonutti, Wheaton, IL (US); Robert T. Thurman, Plainfield, IL (US); William E. Dillon, Chicago, IL (US); David A. Vogel, Island Lake, IL (US)

(73) Assignee: Wilson Sporting Goods Co., Chicago, IL (US)

( * ) Notice: Subject to any disclaimer, the term of this patent is extended or adjusted under 35 U.S.C. 154(b) by 0 days.

(21) Appl. No.: 15/458,820

(22) Filed: Mar. 14, 2017

(65) Prior Publication Data

US 2018/0264327 A1 Sep. 20, 2018

(51) Int. Cl.

| | |
|---|---|
| ***A63B 39/00*** | (2006.01) |
| ***A63B 37/06*** | (2006.01) |
| ***A63B 39/08*** | (2006.01) |
| ***A63B 43/00*** | (2006.01) |
| *A63B 102/02* | (2015.01) |

(52) U.S. Cl.

CPC ..... *A63B 39/08* (2013.01); *A63B 39/00* (2013.01); *A63B 43/002* (2013.01); *A63B 37/06* (2013.01); *A63B 2039/003* (2013.01); *A63B 2039/006* (2013.01); *A63B 2102/02* (2015.10)

(58) Field of Classification Search

CPC ... A63B 39/08; A63B 43/002; A63B 2102/02; A63B 2039/006; A63B 2039/003; A63B 37/06

See application file for complete search history.

(56) References Cited

U.S. PATENT DOCUMENTS

| | | | | |
|---|---|---|---|---|
| 398,558 | A * | 2/1889 | Waddington | B21D 51/08 29/899.1 |
| 902,330 | A * | 10/1908 | Rowley | B29C 65/62 156/147 |
| 1,376,778 | A | 5/1921 | Orr | |
| 2,131,756 | A * | 10/1938 | Roberts | A63B 39/00 473/605 |
| 2,210,954 | A * | 8/1940 | Roberts | B29D 22/04 156/161 |
| 3,065,520 | A | 11/1962 | Schmidt | |
| 3,396,970 | A | 8/1968 | Fraser, Jr. et al. | |
| 3,442,101 | A | 5/1969 | Ploch et al. | |
| 3,684,284 | A | 8/1972 | Tranfield | |
| 3,904,201 | A | 9/1975 | Henry | |
| 4,022,469 | A | 5/1977 | Lacoste et al. | |
| RE29,303 | E | 7/1977 | Fraser, Jr. et al. | |
| 4,098,504 | A | 7/1978 | Koziol et al. | |
| 4,249,730 | A | 2/1981 | Frisk | |

(Continued)

FOREIGN PATENT DOCUMENTS

| | | |
|---|---|---|
| EP | 0022961 A1 | 1/1981 |
| EP | 0576233 | 12/1993 |

(Continued)

*Primary Examiner* — Steven B Wong

(74) *Attorney, Agent, or Firm* — Terence P. O'Brien; Todd A. Rathe

(57) ABSTRACT

A tennis ball may include a spherical hollow core having an inner surface including material shift lines and a textile outer layer over and about the core.

21 Claims, 6 Drawing Sheets

(56) References Cited

U.S. PATENT DOCUMENTS

| | | | | | |
|---|---|---|---|---|---|
| 4,300,767 | A | | 11/1981 | Reed et al. | |
| 4,305,583 | A | * | 12/1981 | Tandon | A63B 39/00 473/609 |
| 4,318,875 | A | | 3/1982 | Shrimpton et al. | |
| 4,340,222 | A | | 7/1982 | Kerkenbush et al. | |
| 4,616,828 | A | * | 10/1986 | Haythornthwaite | A63B 39/06 473/606 |
| 4,853,056 | A | | 8/1989 | Hoffman | |
| 4,853,057 | A | | 8/1989 | Hoffman | |
| 4,946,166 | A | | 8/1990 | Horiuchi et al. | |
| 4,947,466 | A | | 8/1990 | Horiuchi et al. | |
| 5,209,471 | A | | 5/1993 | Horiuchi et al. | |
| 5,211,788 | A | | 5/1993 | Song | |
| 5,225,258 | A | | 7/1993 | Nakamura et al. | |
| 5,308,060 | A | | 5/1994 | Nakamura et al. | |
| 5,413,333 | A | | 5/1995 | Janes et al. | |
| 5,460,367 | A | | 10/1995 | Horiuchi | |
| 5,551,688 | A | | 9/1996 | Miller | |
| 5,558,325 | A | * | 9/1996 | Hargis | A63B 39/00 273/DIG. 4 |
| 5,593,157 | A | | 1/1997 | Koros et al. | |
| 5,830,092 | A | | 11/1998 | Meeks | |
| 5,865,697 | A | * | 2/1999 | Molitor | A63B 41/00 473/604 |
| 6,030,304 | A | | 2/2000 | Simonutti et al. | |
| 6,106,419 | A | | 8/2000 | Hall et al. | |
| 6,227,992 | B1 | | 5/2001 | Brasier | |
| 6,508,732 | B1 | | 1/2003 | Romberger et al. | |
| 6,677,257 | B2 | | 1/2004 | Brasier | |
| 7,611,429 | B2 | | 11/2009 | O'Neill et al. | |
| 7,985,779 | B2 | | 7/2011 | Vleghert | |
| D668,947 | S | | 10/2012 | Niksich | |
| 8,622,857 | B2 | * | 1/2014 | Lo | A63B 41/04 473/604 |
| 2005/0026521 | A1 | | 2/2005 | Brasier | |
| 2007/0178997 | A1 | * | 8/2007 | Chang | A63B 41/02 473/603 |
| 2009/0318251 | A1 | | 12/2009 | Limerkens et al. | |
| 2010/0261563 | A1 | | 10/2010 | Verbeke et al. | |
| 2010/0307637 | A1 | | 12/2010 | Dirst | |
| 2012/0165143 | A1 | | 6/2012 | Kanda et al. | |
| 2012/0298050 | A1 | | 11/2012 | Merritt | |
| 2013/0017912 | A1 | | 1/2013 | DeAngelis-Duffy | |
| 2014/0274504 | A1 | * | 9/2014 | Hu | A63B 37/06 473/604 |

FOREIGN PATENT DOCUMENTS

| | | | |
|---|---|---|---|
| FR | 2638375 | A1 | 5/1990 |
| GB | 719467 | A | 12/1954 |
| WO | 2015/056193 | A1 | 4/2015 |

* cited by examiner

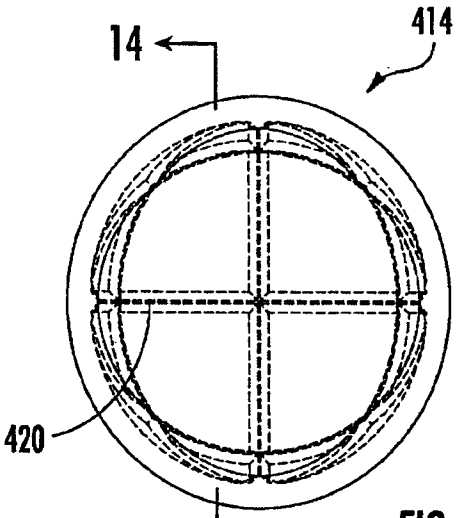
FIG. 10
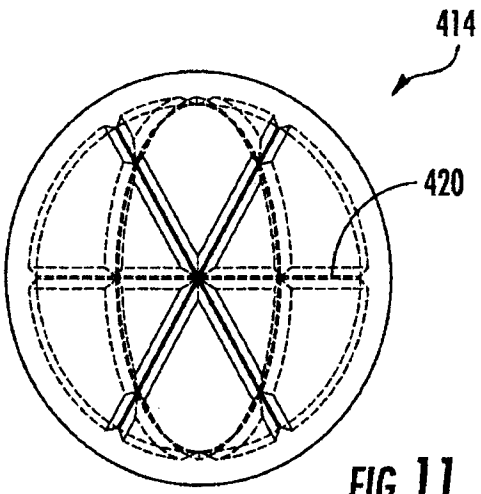
FIG. 11
FIG. 12
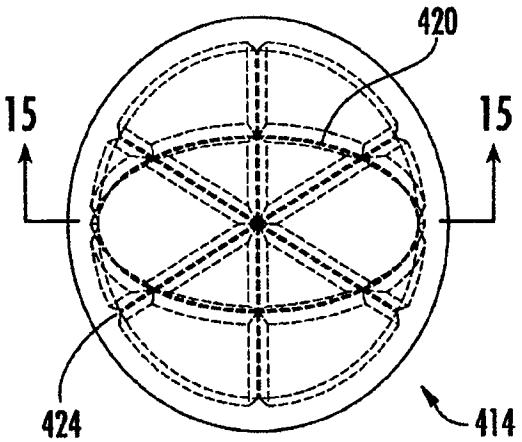
FIG. 13
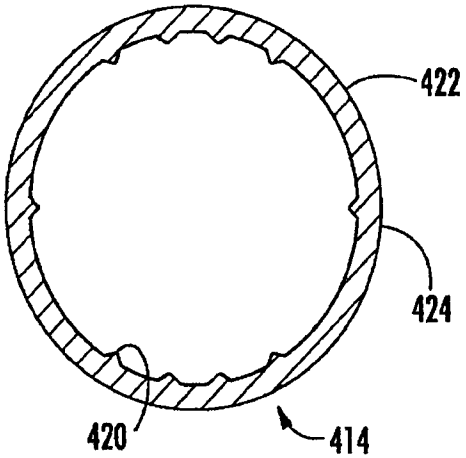
FIG. 14
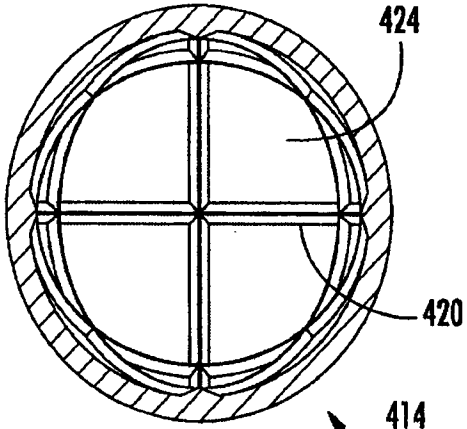
FIG. 15

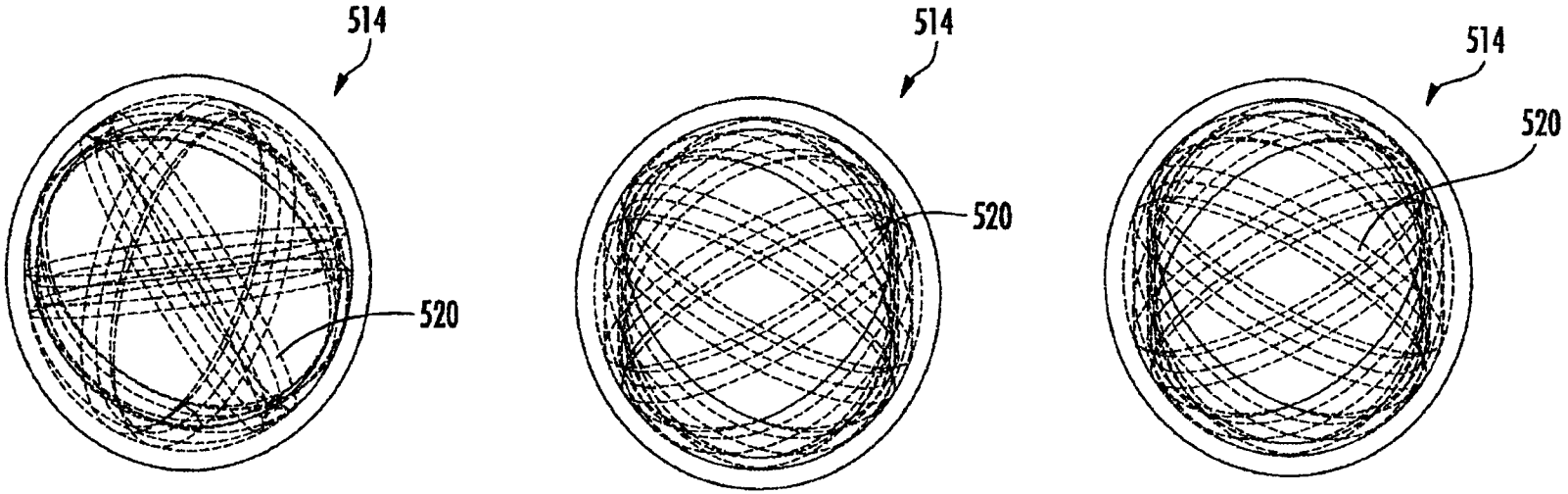
FIG. 16
FIG. 17
FIG. 18
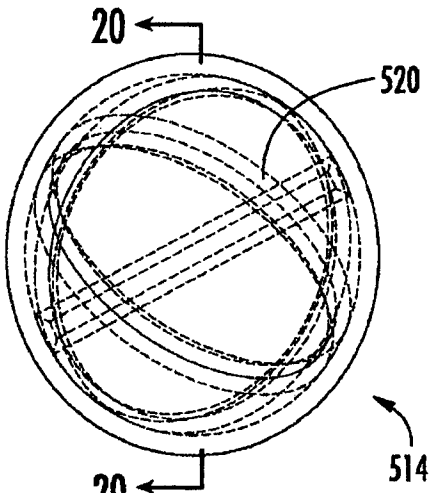
FIG. 19
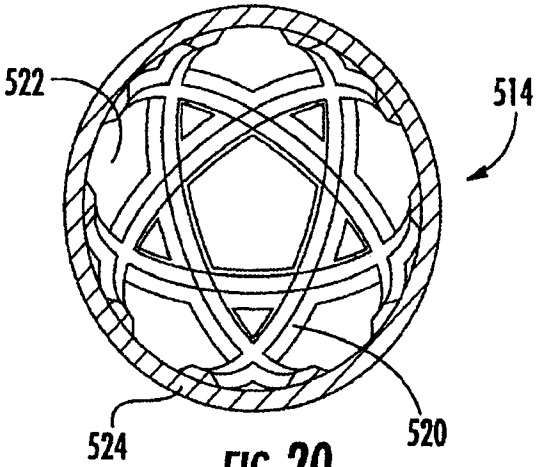
FIG. 20

TENNIS BALL HAVING A CORE WITH INTERNAL MATERIAL SHIFT LINES

BACKGROUND

Tennis balls typically include an elastomeric or rubber-like core about which two dog-bone shaped panels of felt or other textile is bonded. Many tennis balls are pressurized to enhance rebound or bounce performance.

BRIEF DESCRIPTION OF THE DRAWINGS

FIG. 10 is a cross-sectional view of a core of a tennis ball including material shift lines in accordance with another implementation of the present invention.

FIG. 11 is an end side view of the core of FIG. 10 with the material shift lines shown in phantom.

FIG. 12 is a first side view of the core of FIG. 10 with the material shift lines shown in phantom.

FIG. 13 is a second side view of the core of FIG. 10 with the material shift lines shown in phantom.

FIG. 14 is a cross-sectional view of a portion of the core taken along line 14-14 of FIG. 12.

FIG. 15 is a cross-sectional view of the core taken about line 15-15 of FIG. 13.

FIG. 16 is a first side view of a core of a tennis ball with material shift lines shown in phantom in accordance with another implementation of the present invention.

FIG. 17 is a second side view of the core of FIG. 16 with the material shift lines shown in phantom.

FIG. 18 is a third side view of the core of FIG. 16 with the material shift lines shown in phantom.

FIG. 19 is a fourth view of a portion of the core of FIG. 16 with the material shift lines shown in phantom.

FIG. 20 is a cross-sectional view of the core taken along line 20-20 of FIG. 19.

DETAILED DESCRIPTION OF EXAMPLES

Figure 1:
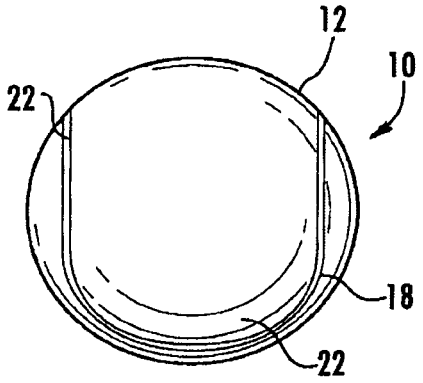
FIG. 1 is a side view of an example tennis ball.

Disclosed herein are examples of tennis balls that have customizable performance characteristics. The example tennis balls may have customizable coefficient of restitution (COR) or a rebound characteristics best suited to a tennis player's or an organization's preferences or player's skill level. For example, some tennis players may prefer a slower tennis ball or a ball that does not bounce as high or as fast. Such slower balls may be easier for a younger or lesser experienced tennis player to keep in play. Other tennis players may prefer a faster tennis ball or a ball that bounces higher.

The example tennis balls disclosed herein facilitate customization of the COR or rebound characteristics of a tennis ball while reducing or eliminating any changes to the weight, feel, sound of impact and other characteristics of the tennis ball. The example tennis balls comprise material shift lines on the inner surface of the core of the tennis balls. Such material shift lines constitute regions where material forming the wall of the core has been shifted such that the remaining portions of the core wall have an altered thickness different than that of the material shift lines. Those remaining portions of the core wall having the altered thickness form a majority of the core wall and provide the core with its overall "effective thickness". Such material shift lines allow the material of the core wall to be shifted to the remaining portions to increase the effective thickness of the core or to be shifted from remaining portions to decrease the effective thickness of the core, all while maintaining the overall weight of the core and the overall size of the core. Providing a greater effective thickness increases COR or rebound characteristics of the tennis ball. Providing a smaller effective thickness also increases the COR or rebound characteristics and the stiffness or resistance to deformation of the tennis ball.

In some implementations, material shift lines comprise ribs or bands along and projecting from the inner surface of the core. The bands of material on the inner surface of the tennis ball core can allow for material from remaining portions of the core wall to be shifted to such bands, reducing the thickness of the remaining portions of the core. Because the remaining portions of the core wall constitute a majority of the core, the "effective thickness", the thickness of the core wall throughout a majority of the core, is reduced. As noted above, this lower thickness or lower "effective thickness" throughout a majority of the tennis ball can increase the COR or rebound characteristics and increase the stiffness or resistance to deformation of the tennis ball. In some implementations, the increased "effective thickness", enhanced COR and increased stiffness may be used to enhance the performance of lower pressure or pressureless tennis balls.

In some implementations, the material shift lines comprise grooves or channels along and recessed into the inner surface of the core. The channels on the inner surface of the tennis ball core may allow material that would otherwise fill the channels to be distributed across remaining portions of the core or core wall. Because the remaining portions of the core wall constitute a majority of the core, the "effective thickness", the thickness of the core wall throughout a majority of the core, is increased. As noted above, the increased thickness or increased "effective thickness" throughout a majority of the tennis ball increases the COR or rebound characteristics of the tennis ball. In some implementations, the increased "effective thickness" and enhanced COR may be used to enhance the performance of lower pressure or pressureless tennis balls.

Figure 2:
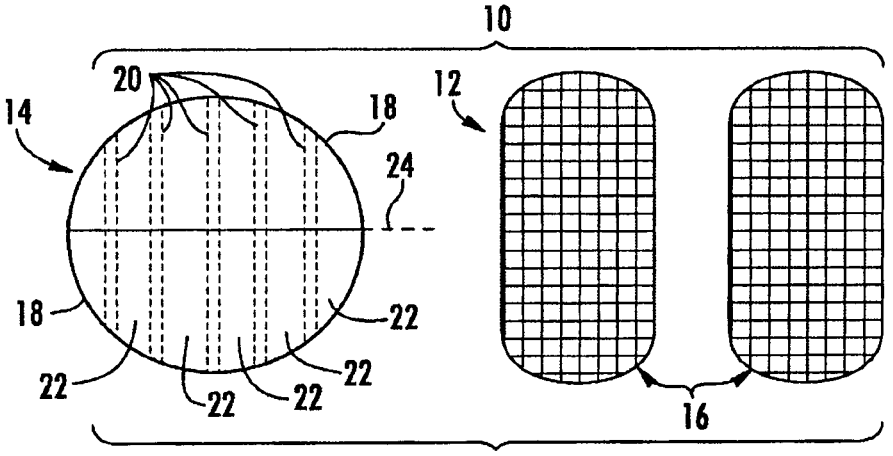
FIG. 2 is an exploded view of another example tennis ball.

FIGS. 1 and 2 illustrate an example tennis ball 10 which utilizes material shift lines to provide a customized COR and/or other ball performance characteristics. FIG. 1 is a perspective view of tennis ball 10 while FIG. 2 is an exploded view of tennis ball 10. As shown by FIGS. 1 and 2, tennis ball 10 comprises outer textile layer 12 and core 14. Outer textile layer 12 comprises at least one layer of fabric material secured over and about core 14. As shown by FIG. 2, in one implementation, outer textile layer 12 comprises two inter-nested, ovular or stadium shaped panels 16. In another implementation, the outer textile layer 12 can comprise a pair of inter-nested dog-bone-shaped panels 16 of textile material bonded to core 14, along seams 18 in other implementations, outer textile layer 12 may be provided by panels having other shapes. In some implementations, textile layer 12 may be formed by fibers not provided in the form of panels, but which are individually joined or bonded to core 14.

In one implementation, tennis ball 10 may be formed by bathing or coating core 14 in an adhesive, such as a synthetic or natural rubber adhesive. In such an implementation, the outer edges of at least one of the two stadium (or dog-bone) shaped panels 16 of textile material are also coated with an adhesive, such as a synthetic or natural rubber adhesive. The panels 16 are then applied over and to the core 14 with the edges of the panels 16 in abutment or close proximity, while the adhesives are in an adhesive state to form the tennis ball shown in FIG. 1. The adhesive is then allowed to dry or cure.

Core 14 comprises a hollow spherical structure having a spherical wall formed from a rubber or rubber-like material. In one implementation, core 14 is faulted from two semi spherical halves or half shells 18 which are molded and joined or bonded together with an adhesive, such as a natural rubber or synthetic rubber adhesive. In one implementation, the two semi-spherical halves or half shells 18 are joined in a pressure chamber so the interior of the joined halves is pressurized. A pressurized tennis ball 10 may have an internal pressure of approximately 10 to 15 psi. In other implementations, the pressure can be below 10 psi. In other implementations, core 14 may be formed in other manners. In other implementations, core 14 may additionally incorporate a valve that facilitates pressurization of the interior of core 14.

As further illustrated by broken lines in FIG. 2, the interior surface of the hollow core 14 comprises material shift lines 20 which are spaced apart by intermediate regions 22. Material shift lines 20 extend along the interior surface of the wall or walls of core 14 and constitute regions where the material or materials of core 14 have been shifted such that material shift lines 20 have a distinct thickness as compared to the thickness through any of regions 22 of the core 14. In one implementation, material shift lines 20 constitute regions where material has been shifted from regions 22 such that material shift lines 20 have a greater thickness as compared to regions 22. Because the thickness of regions 22 is thinner, the effective thickness of such a tennis ball would be reduced. For example, in one implementation, material shift lines 20 may comprise projections, ridges, ribs or bands of material.

In another implementation, material shift lines 20 comprise regions where material has been removed, or from which material has been shifted to regions 22, such that material shift lines 20 have a lesser thickness as compared to regions 22. Because the thickness of regions 22 is thicker, the effective thickness of such a tennis ball would be increased. For example, in one implementation, the shift lines 20 may comprise grooves or channels recessed into the walls of core 14.

In the example illustrated, material shift lines 20 continuously extend around the axis 24 of core 14. Each material shift line 20 extends 360° about axis 24. In the example illustrated, material shift lines 20 extend parallel to one another. In the example illustrated, material shift lines cover or extend across no greater than 5 percent of the interior circumferential surface of core 14. In other implementations, material shift lines 20 may cover other extents of the interior surface of core 14, may have other configurations, or may intermittently extend along or about the interior surface of core 14.

In many implementations, the tennis ball is produced in accordance with specifications of the U.S. Tennis Association (USTA.) and the International Tennis Federation (ITF). For example, the tennis ball can be produced in accordance with the following specifications.

Size: The size of the ball is tested using two ring gauges having internal diameter of 6.54 cm (2.54 inches) and 6.86 cm (2.70 inches). The tennis ball, when tested, must pass through the larger ring gauge and be unable to pass through the smaller ring gauge to meet the size requirements.

Weight: The weight of the ball is measured on a scale that is calibrated to +/−0.01 grams. The acceptable weight of the tennis ball is between 56.0 grams and 59.4 grams.

Deformation: The deformation of the tennis ball is measured using either a Stevens Machine (manually operated) or an automatic compression machine. The deformation of the ball is measured under a load of 80.07 N (18 lb.) after a 15.57 N (3.5 lb.) preload has been applied. The deformation of the ball is required to be between 0.56 cm (0.220 inches) and 0.74 cm (0.291 inches).

Rebound: The rebound of the ball is measured by dropping the ball vertically from a height of 254 cm (100 inches) and measuring the rebound of the tennis ball. The rebound height of the tennis ball should be from 135 cm (53 inches) to 147 cm (58 inches).

Figure 3:
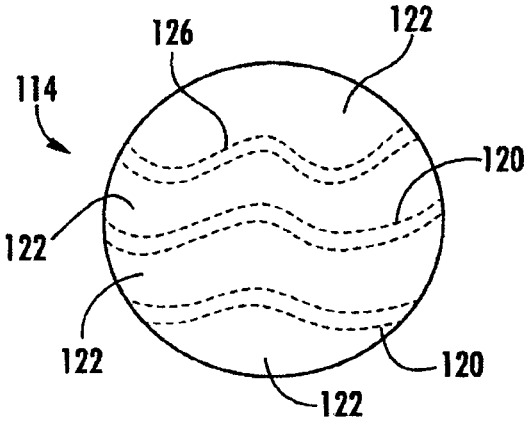
FIG. 3 is a side view of a core of tennis ball including material shift lines in accordance with an implementation of the present invention.
Figure 4:
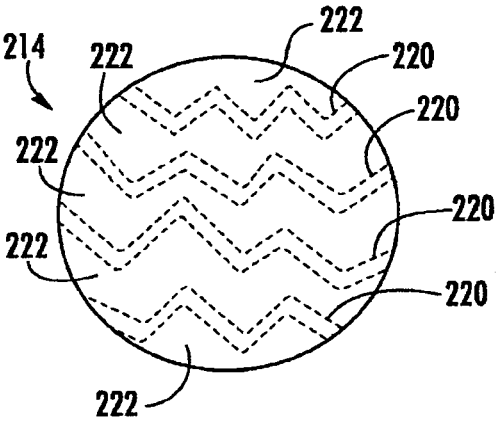
FIG. 4 is a side view of a core of tennis ball including material shift lines in accordance with another implementation of the present invention.

FIGS. 3 and 4 illustrate cores 114 and 214 that may be utilized in place of core 14 in tennis ball 10. Core 114 is similar to core 14 except that core 114 comprises material shift lines 120 spaced by intermediate regions 122. Material shift lines 120 are similar to material shift lines 20 except that material shift lines 120 are not in the form of straight parallel lines about an axis of the core, but instead comprise wavy or sinusoidal lines. Although the wavy material shift lines 120 are illustrated as being in phase with one another, in other implementations, in other implementations, the wavy material shift lines 120 may be out of phase with one another. In some implementations, the wavy material shift lines 120 may extend perpendicular to one another or may cross one another. In other implementations, the wavy material shift lines 120 may comprise wavy spaced segments that collectively intermittently extend about the interior surface of core 114.

Core 214 is similar to core 14 except that core 214 comprises material shift lines 220 spaced by intermediate regions 222. Material shift lines 220 are similar to material shift lines 20 except that material shift lines 220 are not in the form of straight parallel lines about an axis of the core, but instead comprise zigzag or jagged lines. Although the zigzag material shift lines 220 are illustrated as being in phase with one another, in other implementations, in other implementations, the zigzag material shift lines 220 may be out of phase with one another. In some implementations, the zigzag material shift lines 220 may extend perpendicular to one another or may cross one another. In other implementations, the zigzag material shift lines 220 may comprise zigzag spaced segments that collectively intermittently extend about the interior surface of core 214. As discussed above with respect to material shift lines 20, material shift lines 120 and 220 may comprise regions of greater thickness as compared to the remaining intermediate portions 122, 222 to decrease the effective thickness of the core 114, 214 or regions of lesser thickness as compared to the remaining intermediate portions 122 and 222 to increase the effective thickness of core 114, 214.

FIGS. 5-9D illustrate an example core 314 for use in tennis ball 10 in place of core 14. Core 314 is similar to core 14 except that core 314 is specifically illustrated as comprising material shift lines in the form of bands 320. Bands 320 comprise regions along the interior hollow surface 324 of core 314 that have thickness $T_b$ that is greater than the thickness $T_e$, the "effective thickness" of core 314 corresponding to the thickness of the intermediate regions 322 spacing and extending between bands 320. In the example illustrated, bands 320 form a vertical pattern of bands along the interior surface 324 of core 314.

Figures 5, 6, 7, 8, 9A, 9B, 9C, 9D:
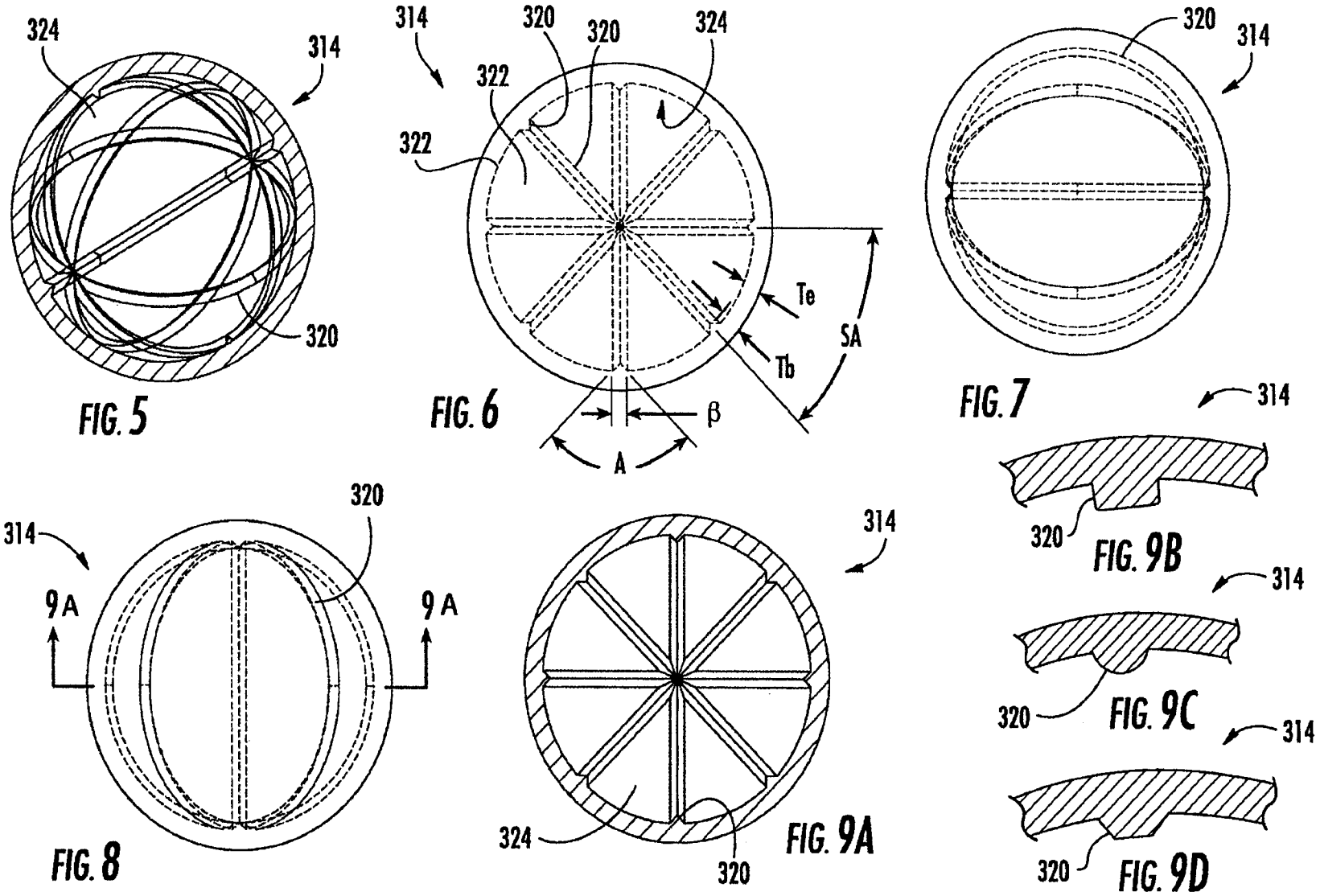
FIG. 5 is a first cross-sectional view of a core of a tennis ball including material shift lines in accordance with another implementation of the present invention.
FIG. 6 is an end side view of the core of FIG. 5 with the material shift lines shown in phantom.
FIG. 7 is a first side view of the core of FIG. 5 with the material shift lines shown in phantom.
FIG. 8 is a second side view of the core of FIG. 5 with the material shift lines shown in phantom.
FIG. 9A is a second cross-sectional view of the core taken along line 9A-9A of FIG. 8.
FIGS. 9B through 9D are fragmentary sectional views of alternative implementations of a portion of the tennis ball core of FIG. 9A.
Figure 23:
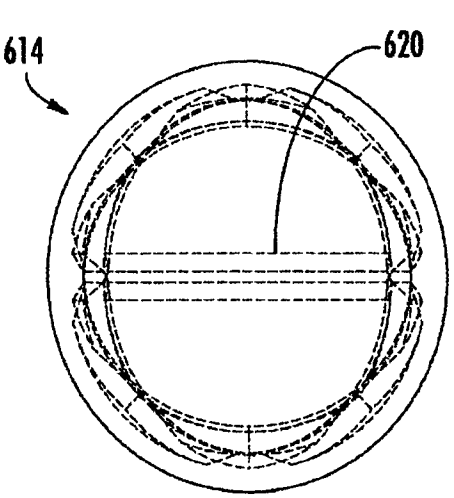
FIG. 23 is a third side view of the core of FIG. 21 with the material shift lines shown in phantom.
Figure 22:
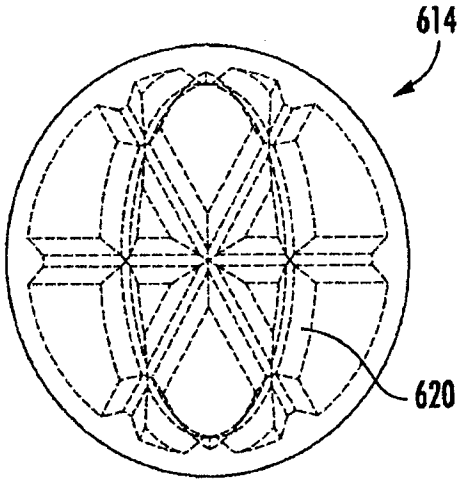
FIG. 22 is a second side view of the core of FIG. 21 with the material shift lines shown in phantom.
Figure 21:
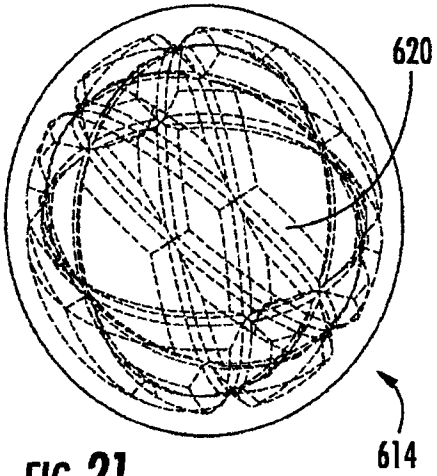
FIG. 21 is a first side view of a core of a tennis ball with material shift lines shown in phantom in accordance with another implementation of the present invention.
Figure 25:
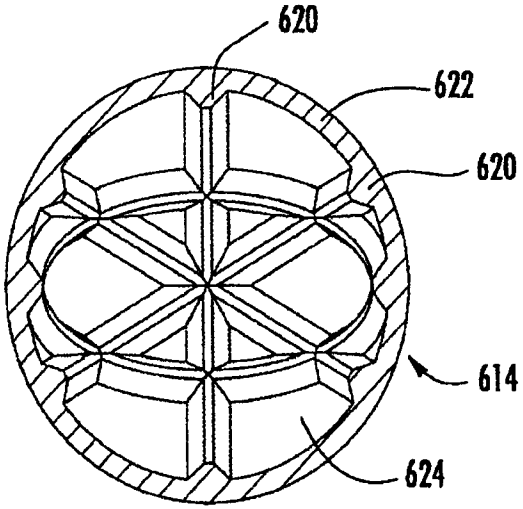
FIG. 25 is a cross-sectional view of the core taken along line 25-25 of FIG. 24.
Figure 24:
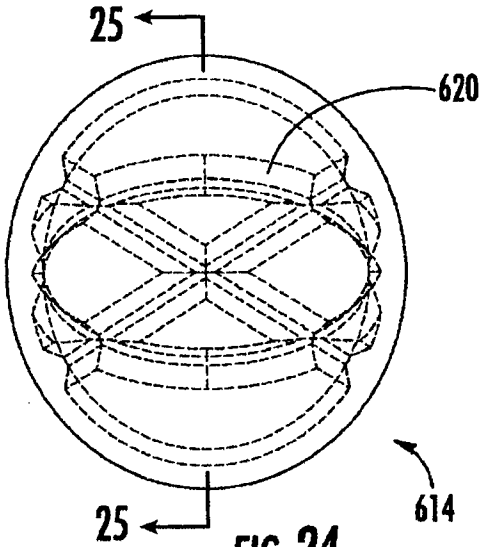
FIG. 24 is a fourth view of a portion of the core of FIG. 21 with the material shift lines shown in phantom.

In the example illustrated, core 314 has a diameter D of approximately 62.7 mm and the interior surface 324 has a radius R of 27.6 mm. In the example illustrated, bands 320 are angularly spaced from another by a spacing angle SA of 45°. In other implementations, core 314 may have other configurations and dimensions. Although bands 320 are illustrated as being pointed or generally triangular in shape (FIG. 9A), having an angle A of 90° and a base B of 3 mm in one implementation, in other implementations, bands 320 may have other shapes and sizes. For example, in other implementations, bands 320 may have a rectangular or square cross sectional shape (FIG. 9B), curved or semi spherical cross-sectional shapes (FIG. 9C), or trapezoidal or polygonal shapes (FIG. 9D). In other implementations, the bands can have a shape that is triangular, rectangular, trapezoidal, polygonal, hemi-spherically shaped, hemi-ovular shaped, rounded, irregular or a combination thereof. In one implementation, bands 320 provide core 314 with a reduction in its effective thickness of 10%.

FIGS. 10-15 illustrate an example core 414 that may be utilized in place of core 14 as part of tennis ball 10 described above. Core 414 is similar to core 314 except that core 414 is specifically illustrated as comprising material shift lines in the form of bands 420. Bands 420 are similar to bands 320 in that bands 420 comprise regions along the interior hollow surface 424 of core 414 that have thickness that is greater than the thickness, the "effective thickness" of core 414 in the intermediate regions 422 spacing and extending between bands 420. Bands 420 have a different pattern within the interior of core 414. In the example illustrated, bands 420 form a trapezoidal pattern of bands along the interior surface 424 of core 414. In one implementation, bands 420 provide core 414 with a reduction in its effective thickness of 10%.

FIGS. 16-20 illustrate an example core 514 that may be utilized in place of core 14 as part of tennis ball 10 described above. Core 514 is similar to core 414 except that core 414 is specifically illustrated as comprising material shift lines in the form of bands 520. Bands 520 are similar to bands 420 in that bands 520 comprise regions along the interior hollow surface 524 of core 514 that have thickness that is greater than the thickness, the "effective thickness" of core 514 in the intermediate regions 522 spacing and extending between bands 520. Bands 520 are larger or wider such that bands 520 provide a further reduced effective thickness of core 514 as measured in those regions 522 between bands 520. Bands 520 have a different pattern within the interior of core 514. In the example illustrated, bands 520 form a trapezoidal pattern of bands along the interior surface 524 of core 514. In one implementation, bands 520 provide core 514 with a reduction in its effective thickness of 20%.

FIGS. 21-25 illustrate an example core 614 that may be utilized in place of core 14 as part of tennis ball 10 described above. Core 614 is similar to core 514 except that core 614 is specifically illustrated as comprising material shift lines in the form of bands 620. Bands 620 are similar to bands 520 in that bands 620 comprise regions along the interior hollow surface 624 of core 614 that have thickness that is greater than the thickness, the "effective thickness" of core 614 in the intermediate regions 622 spacing and extending between bands 620. Bands 620 have a different pattern within the interior of core 614. In the example illustrated, bands 620 form a trapezoidal pattern of bands along the interior surface 624 of core 614. In one implementation, bands 620 provide core 614 with a reduction in its effective thickness of 20%.

The above patterns of bands 320, 420, 520 and 620 provided on the interior surface of the tennis ball cores may have varying thicknesses and widths to provide different degrees of reduction of the effective thickness of the core to reduce the COR of the tennis ball to various extents. In other implementations, bands can provide core with a reduction in its effective thickness of 30%, 40% or 50%. In still other implementations, other amounts of effective thickness reduction of the core can be used. To reduce the effective thickness of the tennis ball core, the volume decrease is to be achieved is based upon the lower "effective" half-shell or core thickness transferred to continuous "bands" extending outward from the inner surface of the core. The volume to be shifted is dependent upon the degree to which the "effective thickness" of the core is adjusted. The volume of material that may be shifted to such bands in various example tennis ball cores is illustrated as follows:

Pressureless Tennis Ball: A pressureless tennis ball may be molded using a half-shell or core that has an outer diameter of approximately 62.7 mm and an inner diameter of approximately 54.7 mm. This results in a thickness of the half-shell of approximately 4.0 mm and an overall material volume of approximately 43.36 $cm^3$. Adjusting the half-shell to a lesser thickness results in the transfer of volume to the outward extending "bands" as follows:

TABLE 1

Volume Displacement (transferred to "bands") based upon Reduction of Effective Thickness - Pressureless Tennis Ball

| Outer Diameter (mm) | Inner Diameter (mm) | Effective Thickness (mm) | Volume Displaced (cm3) | Δ Volume Displaced (%) | Thickness Change % |
|---|---|---|---|---|---|
| 62.7 | 54.7 | 4.0 | 0 | — | — |
| 62.7 | 55.5 | 3.6 | 3.8 | 8.8% | 10% |
| 62.7 | 56.3 | 3.2 | 7.7 | 17.9% | 20% |
| 62.7 | 57.1 | 2.8 | 11.8 | 27.2% | 30% |
| 62.7 | 57.9 | 2.4 | 15.9 | 36.8% | 40% |
| 62.7 | 58.7 | 2.0 | 20.2 | 46.6% | 50% |

The above table shows the amount of volume to be transferred into the "bands" extending outward from the inner surface of the half-shell for each 10% reduction in the effective thickness of the core of a Pressureless Tennis Ball. Reducing the thickness of the core beyond 50% can negatively affect the impact durability of core.

Pressurized Tennis Ball: A pressurized tennis ball is molded using a half-shell or core that has an outer diameter of approximately 61.2 mm and an inner diameter of approximately 54.2 mm. This results in a thickness of the core of approximately 3.5 mm and an overall material volume of 36.65 $cm^3$. Adjusting the half-shell to a lesser thickness results in the need to transfer volume to the outward extending "bands" as follows:

TABLE 2

Volume Displacement (transferred to "bands") based upon Reduction of Effective Thickness - Standard (Pressurized) Tennis Ball

| Outer Diameter (mm) | Inner Diameter (mm) | Effective Thickness (mm) | Volume Displaced (cm3) | Δ Volume Displaced (%) | Thickness Change % |
|---|---|---|---|---|---|
| 61.2 | 54.2 | 3.5 | 0 | 0% | — |
| 61.2 | 54.9 | 3.15 | 3.3 | 8.9% | 10% |
| 61.2 | 55.6 | 2.8 | 6.6 | 18.1% | 20% |
| 61.2 | 56.3 | 2.45 | 10.1 | 27.5% | 30% |
| 61.2 | 57.0 | 2.1 | 13.6 | 37.1% | 40% |
| 61.2 | 57.7 | 1.75 | 17.2 | 47.7% | 50% |

The above table shows the amount of volume to be transferred into the "bands" extending outward from the inner surface of the half-shell for each 10% reduction in the effective thickness of the core of a standard (pressurized) Tennis Ball. Reducing the thickness of the core beyond 50% can negatively affect the impact durability of core.

Figures 26, 27, 28:
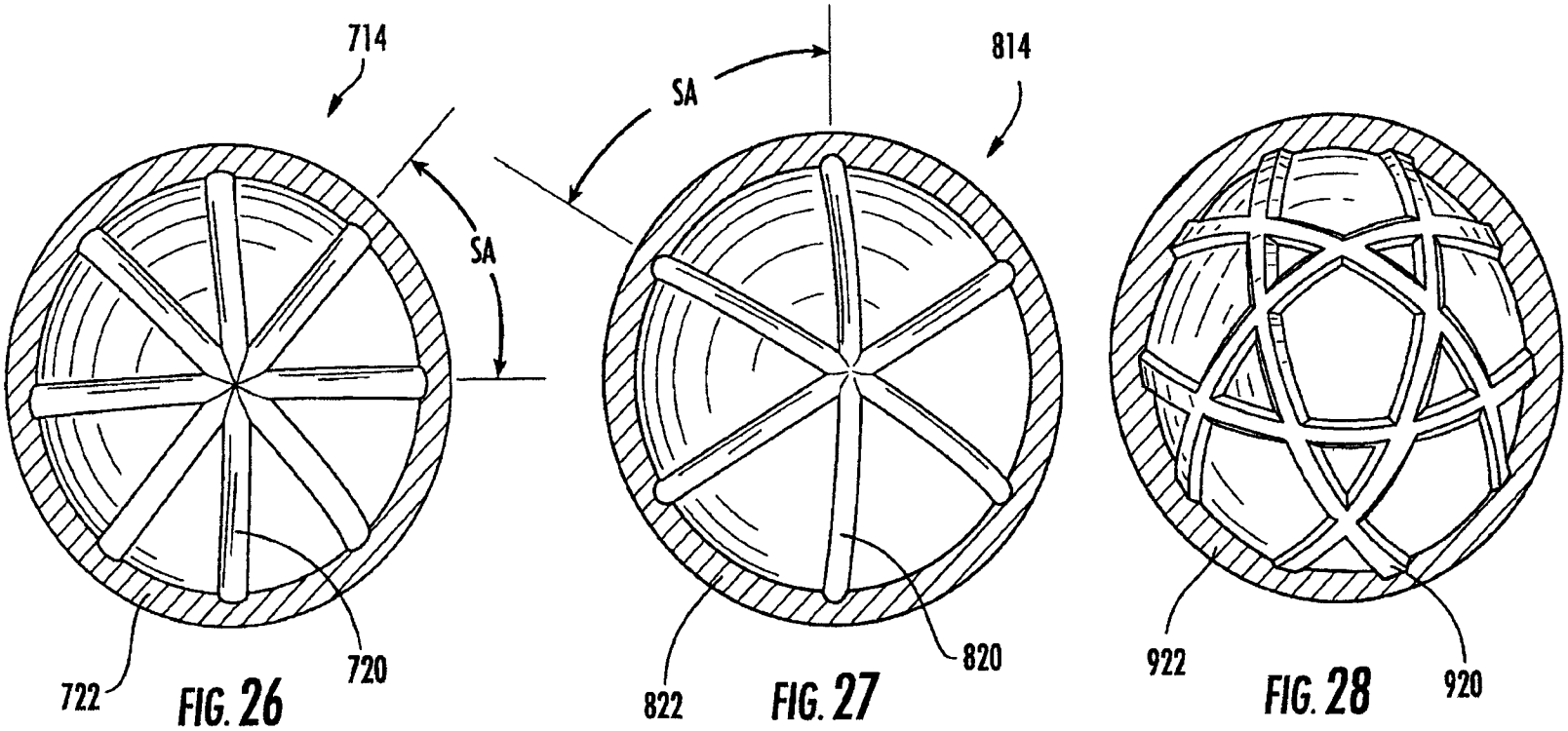
FIG. 26 is a cross-sectional view of a core of a tennis ball including material shift lines in accordance with another implementation of the present invention.
FIG. 27 is a cross-sectional view of a core of a tennis ball including material shift lines in accordance with another implementation of the present invention.
FIG. 28 is a cross-sectional view of a core of a tennis ball including material shift lines in accordance with another implementation of the present invention.

In other implementations, such as the implementations of FIGS. 26-28, the "effective thickness" of the core 714, 814 and 914 can be increased by creating a thicker thickness of the shell or wall thickness of the core. The weight or density of the core can be maintained by defining a plurality of channels or grooves 720, 820 and 920 in the inner surface of the core 714, 814 and 914, respectively. The material of the core 714, 814 and 914 is shifted from the channels 720, 820 and 920 to regions 722, 822 and 922 of the core between the channels 720, 820 and 920. The channels 720 of core 714 are generally V-shaped or generally triangular. The channels 820 and 920 are generally trapezoidal in shape. In the implementation of FIG. 26, the channels 720 are angularly spaced from another by a spacing angle SA of 45°. In the implementation of FIG. 27, the channels 820 are angularly spaced from another by a spacing angle SA of 60°. In the implementation of FIG. 28, the channels 920 are arranged in a different configuration. In other implementations, the channels can be generally U-shaped, hemi-spherically shaped, hemi-ovular shaped, polygonal shaped, rounded, irregular and combinations thereof. In other implementations, channels 720 and 820 can have other configurations, in other spacing angles, other numbers, other shapes and/or other sizes.

For increasing the effective thickness of the tennis ball half-shell, the volume increase based upon the thicker "effective" half-shell or core is transferred from continuous "channels" extending inward from the inner surface of the half-shell. The volume to be shifted is dependent upon the degree to which the "effective thickness" of the half-shell is adjusted. The volume of material that has to be adjusted is illustrated as follows:

Pressureless Tennis Ball: A pressureless tennis ball is molded using a half-shell that has an outer diameter of approximately 62.7 mm and an inner diameter of approximately 54.7 mm. This results in a thickness of the half-shell of approximately 4.0 mm and an overall material volume of 43.36 $cm^3$. Adjusting the half-shell to a greater thickness results in the need to transfer volume to the inward extending "channels" as follows:

TABLE 3

Volume Displacement (transferred to "channels") based upon Increase in Effective Thickness - Pressureless Tennis Ball

| Outer Diameter (mm) | Inner Diameter (mm) | Effective Thickness (mm) | Volume Displaced (cm3) | Δ Volume Displaced (%) | Thickness Change % |
|---|---|---|---|---|---|
| 62.7 | 54.7 | 4.0 | 0 | — | — |
| 62.7 | 53.9 | 4.4 | 2.738 | 6.3% | 10% |
| 62.7 | 53.1 | 4.8 | 7.647 | 14.4% | 20% |
| 62.7 | 52.3 | 5.2 | 11.899 | 22.3% | 30% |

The above table shows the amount of volume transferred into the "channels" extending inward from the inner surface of the half-shell for each 10% increase in the effective thickness of the core of a Pressureless Tennis Ball. Increase of the thickness of the core by greater than 30% may result in a necessary removal of an unacceptable high amount of volume that would result in "channels" that are larger than could be incorporated into the half-shell.

Pressurized Tennis Ball: A tennis ball is molded using a half-shell that has an outer diameter of approximately 61.2 mm and an inner diameter of approximately 54.2 mm. This results in a thickness of the half-shell of approximately 3.5 mm and an overall material volume of 36.65 $cm^3$. Adjusting the half-shell or core to a greater thickness results in the transfer of volume or mass from the area of the channels as follows:

TABLE 4

Volume Displacement (transferred to "channels") based upon Increase in Effective Thickness - Standard (Pressurized) Tennis Ball

| Outer Diameter (mm) | Inner Diameter (mm) | Effective Thickness (mm) | Volume Displaced (cm3) | Δ Volume Displaced (%) | Thickness Change % |
|---|---|---|---|---|---|
| 61.2 | 54.2 | 3.5 | 0 | 0% | — |
| 61.2 | 53.5 | 3.85 | 3.2 | 8.7% | 10% |
| 61.2 | 52.8 | 4.2 | 6.3 | 17.2% | 20% |
| 61.2 | 52.1 | 4.55 | 9.3 | 25.4% | 30% |

The above table shows the amount of volume transferred into the "channels" extending inward from the inner surface of the half-shell for each 10% increase in the effective thickness of the core of a Standard (Pressurized) Tennis Ball. Increase of the thickness of the core by greater than 30% may result in a necessary removal of an unacceptable high amount of volume that would result in "channels" that are larger than could be incorporated into the half-shell.

EXAMPLES

Core 614 (shown in FIG. 23-25) was molded with a band pattern comprising an offset trapezoidal band pattern resulting in a half-shell having the following properties:

Inner radius—27.6 mm.

Calculated Volume (ball—2 half-shells)—42.86 $cm^3$.

Effective Thickness—~3.6 mm (10% reduction from standard).

Core 514 (shown in FIGS. 18-20) was molded with a band pattern comprising a symmetrical trapezoidal band pattern resulting in a half-shell having the following properties:

Inner radius—28.2 mm.

Calculated Volume (ball—2 half-shells)—43.28 $cm^3$.

Effective Thickness—~3.2 mm (20% reduction from standard).

Core 714 (shown in FIG. 26) was molded with a channel pattern comprising vertical or generally V-shaped channels resulting in a half shell having the following properties:

Inner radius—27 mm.

Calculated Volume (ball—2 half-shells)—43.73 $cm^3$.

Effective Thickness—~4.4 mm (10% increase from standard).

Core 814 (shown in FIG. 27) was molded with a channel pattern comprising an offset trapezoidal channel pattern resulting in a half-shell having the following properties:

Inner radius—27 mm.

Calculated Volume (ball—2 half-shells)—43.09 $cm^3$.

Effective Thickness—~4.4 mm (10% increase from standard).

Core 914 (shown in FIG. 28) was molded with a channel pattern comprising a symmetrical trapezoidal channel pattern resulting in a half-shell having the following properties:

Inner radius—27 mm.

Calculated Volume (ball—2 half-shells)—43.09 $cm^3$.

Effective Thickness—~4.4 mm (10% increase from standard).

Pressureless tennis balls were molded using the tooling as defined above using a standard pressureless ball compound as follows:

| Pressureless Ball Compound | | | | | |
|---|---|---|---|---|---|
| | | SP. | Experiment IV | | |
| No. | | GR | phr. | Wt. (g) | Volume |
| | Ingredient | | | | |
| 1 | NR#1 | 0.93 | 20 | 9.000 | 9.68 |
| 2 | BR-01 | 0.91 | 80 | 36.000 | 39.56 |
| 3 | Rigidex H5818 | 0.916 | 20 | 9.000 | 9.83 |
| 4 | HiSil255 | 2 | 8 | 3.600 | 1.80 |
| 5 | ZnO—active | 5.6 | 10 | 4.500 | 0.80 |
| 6 | CLAY | 2.6 | 20 | 9.000 | 3.46 |
| 7 | DPG | 1.18 | 0.5 | 0.225 | 0.19 |
| 8 | PTA | 1.33 | 0.5 | 0.225 | 0.17 |
| | Total | | 159.00 | 71.550 | 65.488 |
| | Chemical mixing | | | | |
| 1 | DM | 0.154 | 1.46 | 0.657 | 4.27 |
| 2 | DPG | 1.18 | 0.59 | 0.266 | 0.23 |
| 3 | CBS | 1.36 | 0.512 | 0.230 | 0.17 |
| 4 | S-25 | 2.07 | 5.56 | 2.502 | 1.21 |
| | Total | | 1.054 | 75.205 | 71.368 |

Pressureless tennis balls molded with continuous "bands" or "channels" incorporated in the half shell were tested and compared to a standard pressureless tennis ball formed of the same material composition.

Results of testing were as follows:

Ball Physical Properties:

| Ball | | Size | Wt.(g) | Deform. Stevens | Deform. Instron | Reb. | C.O.R. 60 f/s | C.O.R. 120 f/s |
|---|---|---|---|---|---|---|---|---|
| Core 614 | Avg. | 2.596" | 58.3 | 0.225" | 0.2670" | 56.1" | 0.617 | 0.426 |
| | Range | 2.575-2.610" | 57.6-58.9 | 0.216-0.235" | 0.2576-0.2761" | 55.4-56.7" | | |
| | StDev | 0.011 | 0.4 | 0.007 | 0.0093 | 0.4 | | |
| Core 514 | Avg. | 2.598" | 58.3 | 0.223" | 0.2652" | 56.2" | 0.628 | 0.433 |
| | Range | 2.590-2.610" | 57.5-59.0 | 0.216-0.233" | 0.2589-0.2726" | 55.5-56.7" | | |
| | StDev | 0.006 | 0.4 | 0.007 | 0.0069 | 0.4 | | |
| Core 714 | Avg. | 2.603" | 58.5 | 0.240" | 0.2832" | 54.9" | 0.618 | 0.424 |
| | Range | 2.600-2.610" | 57.7-59.3 | 0.231-0.245" | 0.2779-0.2864" | 53.9-55.6" | | |
| | StDev | 0.005 | 0.5 | 0.005 | 0.0046 | 0.6 | | |
| Core 814 | Avg. | 2.596" | 58.3 | 0.237" | 0.2757" | 54.5" | 0.615 | 0.430 |
| | Range | 2.590-2.600" | 57.5-58.8 | 0.227-0.245" | 0.2691-0.2824" | 53.1-55.3" | | |
| | StDev | 0.005 | 0.4 | 0.007 | 0.0066 | 0.7 | | |
| Core 914 | Avg. | 2.590" | 58.4 | 0.237" | 0.2755" | 55.0" | 0.615 | 0.423 |
| | Range | 2.580-2.600" | 57.8-58.9 | 0.231-0.248" | 0.2748-0.2764" | 54.6-55.5" | | |
| | StDev | 0.006 | 0.3 | 0.007 | 0.0008 | 0.4 | | |
| Standard pressureless | Avg. | 2.599" | 57.7 | 0.238" | 0.2814" | 55.2" | 0.609 | 0.427 |
| | Range | 2.590-2.610" | 57.2-58.3 | 0.231-0.242" | 0.2732-0.2870" | 54.5-55.9" | | |
| | StDev | 0.007 | 0.4 | 0.004 | 0.0073 | 0.5 | | |

Deformation measurements were recorded in accordance with U.S.T.A. Specifications using Stevens deformation protocol and through use of an Instron universal test machine. Rebound measurements taken in accordance with U.S.T.A. Specifications wherein the tennis ball is dropped from a height of 100 inches and the height of the rebound is recorded (U.S.T.A. Specifications require a rebound height within the range of 53 to 58 inches). Examples of pressureless tennis balls molded with continuous "bands" to reduce effective cover thickness showed the following:

- Core 614 (10% effective reduction in cover thickness) exhibited:
  - Lower deformation (higher stiffness) than the standard pressureless ball (the Wilson trainer tennis ball).
  - Higher C.O.R. at test velocity of 60 ft/s than the standard pressureless ball.
  - Comparable C.O.R. at test velocity of 120 ft/s compared to the standard pressureless ball.
- Core 514 (20% effective reduction in cover thickness) exhibited:
  - Lower deformation (higher stiffness) than the standard pressureless ball (the Wilson trainer tennis ball).
  - Significantly higher C.O.R. at test velocity of 60 ft/s than the standard pressureless ball Wilson Trainer control ball.
  - Higher C.O.R. at test velocity of 120 ft/s than the standard pressureless ball.
- Core 714 (10% effective increase in cover thickness) exhibited:
  - Comparable deformation compared to the standard pressureless ball (the Wilson trainer tennis ball).
  - Higher C.O.R. at test velocity of 60 ft/s than the standard pressureless ball.
  - Comparable C.O.R. at test velocity of 120 ft/s compared to standard pressureless ball.
- Core 814 (10% effective increase in cover thickness) exhibited:
  - Comparable deformation compared to the standard pressureless ball (the Wilson trainer tennis ball).
  - Higher C.O.R. at test velocity of 60 ft/s than the standard pressureless ball.
  - Slightly higher C.O.R. at test velocity of 120 ft/s compared to standard pressureless ball.
- Core 914 (10% effective increase in cover thickness) exhibited:
  - Comparable deformation compared to the standard pressureless ball (the Wilson trainer tennis ball).
  - Higher C.O.R. at test velocity of 60 ft/s than the standard pressureless ball.
  - Comparable C.O.R. at test velocity of 120 ft/s compared to the standard pressureless ball.

Overall results showed the following:

- Pressureless tennis balls made with continuous "bands" to reduce the effective thickness of the tennis ball core exhibited the following:
  - Lower deformation/increased stiffness compared to the standard pressureless ball.
  - Significant increase (0.008-0.019) in C.O.R. at test velocity of 60 ft/s compared to the standard pressureless ball.
- Pressureless tennis balls made with continuous "channels" to increase the effective thickness of the tennis ball core exhibited the following:
  - Comparable deformation compared to the standard pressureless ball.
  - Increase in C.O.R. of 0.006-0.009 at test velocity of 60 ft/s compared to the standard pressureless ball.

The incorporation of continuous bands that extend outward (into the hollow center) from the inner surface of the tennis ball half-shell serve to increase the stiffness (reduce the deformation) of the molded tennis ball. The presence of the continuous bands also results in an increase in tennis ball C.O.R.

The incorporation of continuous channels that extend inward into the molded half-shell have minimal effect on the deformation of the tennis ball. However, an increase in C.O.R. of the tennis ball is also observed in tennis balls incorporating the inward-extending channels.

The adjustment of the tennis ball thickness to a thinner effective core is far easier to perform, as the volume of material that can be shifted to the "bands" that will extend outward from the half-shell is significantly greater than the amount of volume that can be shifted to "channels" that will extend inward from the inner surface of the tennis ball core. The degree of which the effective thickness of the core can be increased is limited as the corresponding volume would need to be incorporated as inward-extending channels. Any level of increase of the effective thickness over about 30% results in inward-extending channels that would result in core/shell thickness between the innermost portion of the inward-extending channels and the outer surface of the half-shell that would be insufficiently thick and result in impact durability issues for the molded tennis ball.

A tennis ball can include a spherical hollow core having an inner surface comprising material shift lines, and a textile outer layer over and about the core. Implementations of the present invention can include one or more of the following elements. The material shift lines can be channels extending into the inner surface forming a plurality of regions of reduced core thickness. Portions of the spherical hollow core between the channels can have a thickness of at least 4 mm. Portions of the spherical hollow core between the channels have a thickness of at least 4.4 mm. The channels can have a collective volume of at least 2 $cm^3$. An interior volume of the spherical hollow core can be pressurized to a pressure of at least 10 psi and portions of the spherical hollow core between the channels can have a thickness of at least 3.7 mm. An interior volume of the spherical hollow core can be pressurized to a pressure of at least 10 psi and the channels can have a collective volume of at least 3 $cm^3$. The channels can cover no greater than about 48% of a total inner surface area of the spherical hollow core. The material shift lines can include bands projecting from the inner surface forming a plurality of regions of increased core thickness. Portions of the spherical hollow core between the bands can have a thickness of no greater than 3.6 mm. Portions of the spherical hollow core between the bands can have a thickness of no greater than 3.2 mm. The bands can have a collective volume of at least 3 $cm^3$. The bands can have a collective volume of at least 8% of a total material volume of the spherical hollow core. An interior volume of the spherical hollow core can have an internal pressure of less than 5 psi and portions of the spherical hollow core between the bands can have a thickness of less than 3.7 mm. An interior volume of the spherical hollow core can have an internal pressure of less than 5 psi and the portions of the spherical hollow core between the bands can have a thickness of less than 3.3 mm. An interior volume of the spherical hollow core can have an internal pressure of less than 5 psi and the bands can have a collective volume of at least 3.3 $cm^3$. The bands can have a collective volume of at least 8% of a total material volume of the spherical hollow core. The bands can cover no greater than about 51% of a total inner surface area of the spherical hollow core. The channels or the bands can have a cross-sectional shape selected from the group consisting of generally V-shaped, generally U-shaped, hemi-spherically shaped, hemi-ovular shaped, polygonal shaped, rounded, irregular and combinations thereof.

Although the present disclosure has been described with reference to example implementations, workers skilled in the art will recognize that changes may be made in form and detail without departing from the spirit and scope of the claimed subject matter. For example, although different example implementations may have been described as including one or more features providing one or more benefits, it is contemplated that the described features may be interchanged with one another or alternatively be combined with one another in the described example implementations or in other alternative implementations. Because the technology of the present disclosure is relatively complex, not all changes in the technology are foreseeable. The present disclosure described with reference to the example implementations and set forth in the following claims is manifestly intended to be as broad as possible. For example, unless specifically otherwise noted, the claims reciting a single particular element also encompass a plurality of such particular elements.

What is claimed is:

1. A tennis ball comprising:

a spherical hollow core consisting of two joined semi spherical halves, the spherical hollow core having an interior volume with an internal pressure of less than 5 psi and an inner surface comprising material shift lines;

an adhesive layer continuously coating and directly contacting an entirety of an exterior surface of the spherical hollow core without interruption; and a textile outer layer over and about the core, the textile outer layer being directly bonded to the entire exterior surface of the spherical hollow core, without interruption, by the adhesive layer, wherein the material shift lines comprise a plurality of channels extending into the inner surface forming a plurality of regions of reduced core thickness.

2. The tennis ball of claim 1, wherein portions of the spherical hollow core between the channels have a thickness of at least 4 mm.

3. The tennis ball of claim 1, wherein portions of the spherical hollow core between the channels have a thickness of at least 4.4 mm.

4. The tennis ball of claim 1, wherein the channels have a collective volume of at least 2 $cm^3$.

5. The tennis ball of claim 1, wherein the channels cover no greater than about 48% of a total inner surface area of the spherical hollow core.

6. The tennis ball of claim 1, wherein the channels comprise at least one individual channel continuously and without interruption extending 360° about the inner surface of the spherical hollow core.

7. The tennis ball of claim 1, wherein the channels have a pattern selected from a group of patterns consisting of: a vertical pattern wherein the channels intersect at opposite poles; an offset pattern; and a symmetrical pattern.

8. A tennis ball comprising:

a spherical hollow core consisting of two joined semi spherical halves, the spherical hollow core having an interior volume with an internal pressure of less than 5 psi and an inner surface comprising material shift lines;

an adhesive layer continuously coating and directly contacting an entirety of an exterior surface of the spherical hollow core without interruption; and a textile outer layer over and about the core, the textile outer layer being directly bonded to the entire exterior surface of the spherical hollow core, without interruption, by the adhesive layer, wherein the material shift lines comprise bands projecting from the inner surface forming a plurality of regions of increased core thickness.

9. The tennis ball of claim 8 wherein portions of the spherical hollow core between the bands have a thickness of no greater than 3.6 mm.

10. The tennis ball of claim 8 wherein portions of the spherical hollow core between the bands have a thickness of no greater than 3.2 mm.

11. The tennis ball of claim 8, wherein the bands have a collective volume of at least 3 $cm^3$.

12. The tennis ball of claim 8, wherein the bands have a collective material volume, which is at least 8% of a total material volume of the spherical hollow core.

13. The tennis ball of claim 8, wherein an interior volume of the spherical hollow core has an internal pressure of less than 5 psi and wherein portions of the spherical hollow core between the bands have a thickness of less than 3.7 mm.

14. The tennis ball of claim 8, wherein the portions of the spherical hollow core between the bands have a thickness of less than 3.3 mm.

15. The tennis ball of claim 8, wherein the bands have a collective volume of at least 3.3 $cm^3$.

16. The tennis ball of claim 8, wherein the bands cover no greater than about 51% of a total inner surface area of the spherical hollow core.

17. The tennis ball of claim 8, wherein the bands comprise at least one channel extending 360° about the inner surface of the spherical hollow core.

18. The tennis ball of claim 8, wherein the bands have a pattern selected from a group of patterns consisting of: a vertical pattern wherein the bands intersect at opposite poles; an offset pattern and a symmetrical pattern.

19. The tennis ball of claim 8, wherein the bands have a cross-sectional shape selected from the group consisting of generally triangular, rectangular, trapezoidal, polygonal, hemi-spherically shaped, hemi-ovular shaped, rounded, irregular and combinations thereof.

20. A tennis ball comprising:

a spherical hollow core having an interior volume with an internal pressure of less than 5 psi and having an inner surface comprising material shift lines; and a textile outer layer over and about the core, wherein the material shift lines comprise channels extending into the inner surface forming a plurality of regions of reduced core thickness and wherein the channels comprise at least one individual channel that continuously and without interruption extends 360° about the inner surface of the spherical hollow core.

21. The tennis ball of claim 20 further comprising an adhesive layer continuously coating and directly contacting an entirety of an exterior surface of the spherical hollow core without interruption, wherein the textile outer layer is directly bonded to the entire exterior surface of the spherical hollow core, without interruption, by the adhesive layer.

* * * * *